United States Patent [19]

Furlow et al.

[11] Patent Number: 4,974,709

[45] Date of Patent: Dec. 4, 1990

[54] COMMUTER CASE

[76] Inventors: Thelma L. Furlow; Lisa M. Furlow, both of 10232 Sherbrook La., Dallas, Tex. 75229

[21] Appl. No.: 382,281

[22] Filed: Jul. 20, 1989

[51] Int. Cl.[5] ..... A45C 3/00; A45C 3/12; A45C 13/10; A45C 13/40

[52] U.S. Cl. ..... 190/102; 190/108; 150/111; 383/37; 383/61; 383/74; 383/76; 383/86

[58] Field of Search ..... 383/61, 71, 72, 86, 383/76, 74, 6, 31, 15, 37; 190/102, 168; 150/108, 111; 224/236, 237, 252, 269, 915

[56] References Cited

U.S. PATENT DOCUMENTS

| | | | |
|---|---|---|---|
| 308,418 | 11/1884 | Lockwood | 383/72 X |
| 688,671 | 12/1901 | Nason | 383/71 |
| 1,096,537 | 5/1914 | Humphreys | 383/61 |
| 1,148,924 | 8/1915 | Paradise | 383/71 |
| 1,214,282 | 1/1917 | Day | 224/236 X |
| 1,727,954 | 9/1929 | Beehler | 190/102 X |
| 1,824,508 | 9/1931 | Shipman | 383/86 |
| 2,407,787 | 9/1946 | Kernahan | 224/236 X |
| 2,707,035 | 4/1955 | Lashley | 190/108 X |
| 2,737,221 | 3/1956 | Knox | 383/86 X |
| 3,225,806 | 12/1965 | Pollak et al. | 383/61 X |

FOREIGN PATENT DOCUMENTS

| | | | |
|---|---|---|---|
| 84837 | 7/1921 | Australia | 383/76 |
| 500121 | 2/1954 | Canada | 224/269 |
| 1237028 | 6/1960 | France | 383/6 |
| 2358124 | 2/1978 | France | 190/102 |
| 382924 | 11/1932 | United Kingdom | 190/102 |
| 396926 | 8/1933 | United Kingdom | 190/102 |

*Primary Examiner*—Sue A. Weaver

[57] ABSTRACT

A multiple use commuter case or bag which may be attached to a handle or the like of another bag, case, etc. This case accommodates articles that may not suitably fit in a primary carrier such as shoes, foods, supplies, bulky equipment, or personal articles. The case affixes to the primary carrier by a strap allowing both articles to be transported as one. When the case in not needed, it can be detached, collapsed, and rolled up. The strap then fastens around the case so that it remains rolled up.

20 Claims, 3 Drawing Sheets

COMMUTER CASE

BACKGROUND OF THE INVENTION

This invention generally relates to small cases and more particularly to commuter cases for carrying shoes, athletic clothing, bag lunches, newspapers, umbrellas, and assorted personal items.

Women have joined the work force in increasing numbers, and they often commute to work wearing jogging, tennis or walking shoes while carrying their dress or work shoes. A variety of containers such as paper and plastic bags, handbags, and briefcases have been used for carrying their dress or work shoes. However, plastic and paper bags are subject to tearing, and they often do not sufficiently protect, items such as shoes, to prevent them from being scratched, crushed or broken. Handbags and briefcases have been found to be unsatisfactory for carrying shoes, for example, because of space limitations, and shoes often soil the contents of the handbag or the briefcase.

Commuters, both male and female, also often carry a variety of incidental items such as athletic clothing, bag lunches, newspapers, umbrellas, thermos bottles, and the like. An attempt to carry one or more of these items in the user's hands will often result in dropping or losing one or more of these items or worse, injury to the carrier or fellow commuters. Attempts to stuff these items in briefcase or attache cases will often results in wet and dirty contents due to, for example, a leaking thermos, a wet umbrella, a soggy lunch bag, etc. It is also noted that many of these items do not easily fit in many briefcases or attache cases. The present invention overcomes one or more problems commuters have in carrying various items to and from work or social activities by providing a commuter case designed to accommodate a variety of personal items.

Accordingly, one object of the present invention is to provide a flexible carrier which can be attached to another piece of luggage or carried separately by the user for the orderly transportation of shoes, athletic clothing, bag lunches, newspapers, umbrellas, thermos bottles, and other assorted personal items.

Another object of the invention is to provide a flexible carrier for a person's dress or work shoes which reduces the likelihood of scuffing and other damage to the shoes.

Yet another object of the invention is to provide a case for items carried by commuters which is economical to manufacture and which can be rolled up and stored in a compact manner when not in use.

A further object of the invention is the provision of a commuter case which is of relatively compact, efficient design and which can be deployed and used with relative ease.

SUMMARY OF THE INVENTION

A commuter case or bag for carrying assorted personal items includes elongated front, rear and side walls which are joined to a bottom wall, and an elongated flap which, is secured to the upper end portion of the rear wall and which, in closed position, extends across the mouth of the case and overlaps the front wall of the case. A closure means for the case includes a drawstring element that extends through apertures in the front, rear and side walls of the case and an adjustable fastener which is attached to the drawstring for maintaining the bag in closed position. The drawstring cooperates with a releasable clamp means associated with the flap to adjustably secure the flap at a predetermined position with respect to the front wall of the case. The clamp means includes a lever which pivots from an open position in which the drawstring is freely moveable with respect to the clamp means to a closed position in which the flap is held in a fixed position with respect to the drawstring. The upper portions of the front, rear and side walls of the case can be selectively provided with reinforcing elements for reinforcing the mouth of the case. Elongated, bulky items which do not easily fit within the bag may be carried across the mouth of the bag with the flap overlying the item and secured in a fixed position with respect to the front wall of the case. An internal strap in the case may be utilized to assist in holding the item across the mouth of the case and to secure articles carried within the case. The upper edges of the side walls may slope downwardly from the front wall to the rear wall of the case to bias items carried across the mouth toward the rear wall of the case. Carrying means for the case include long and short strap elements which are pivotally connected to the upper portion of the rear wall of the case. One arrangement for using the strap elements is to connect the end portions of the strap elements together to form a loop or handle for permitting the user to either hand-carry the case or to loop the strap elements around the handle of a bag or briefcase. A second arrangement for use of the strap elements is to pivot the strap elements so that the short strap can be connected directly to the connecting hardware of the handle of bag, briefcase or other type of luggage. When not in use, the strap elements encircle the rolled up case for storage.

DETAILED DESCRIPTION OF THE INVENTION

Figure 1:
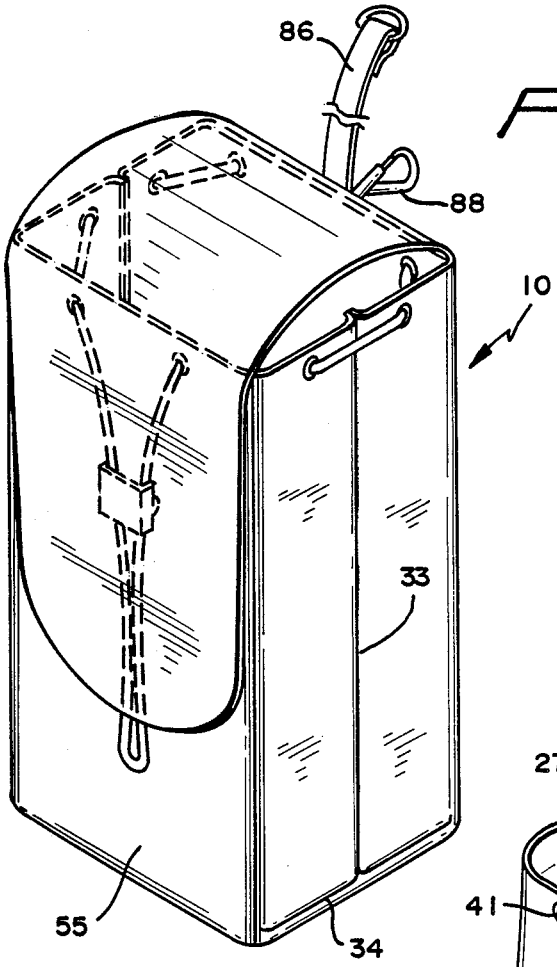
FIG. 1 is a perspective view of the case or bag.

Referring to FIGS. 1 through 9, there is generally shown a commuter case or bag 10 comprising a front wall 55, a rear wall 60, side walls 65 and 70, a bottom 75 and a flap 80, which is secured to the upper portion of the rear wall 60.

Preferably, the walls and the bottom portion of the case are formed of a flexible material such as a pliable leather, nylon, or cloth. The flap portion 80 may be formed of the same material as the walls and the bottom portion, and the flap 80 may be formed of multiple layers of material to provide the flap 80 with a greater stiffness than the other portions of the case. This allows the flap 80 to adequately enclose auxiliary items 51 carried by the case 10 such as shown in FIG. 8 and to allow the flap 80 to surround the wall and bottom portions when the case 10 assumes a rolled-up configuration.

Figure 2:
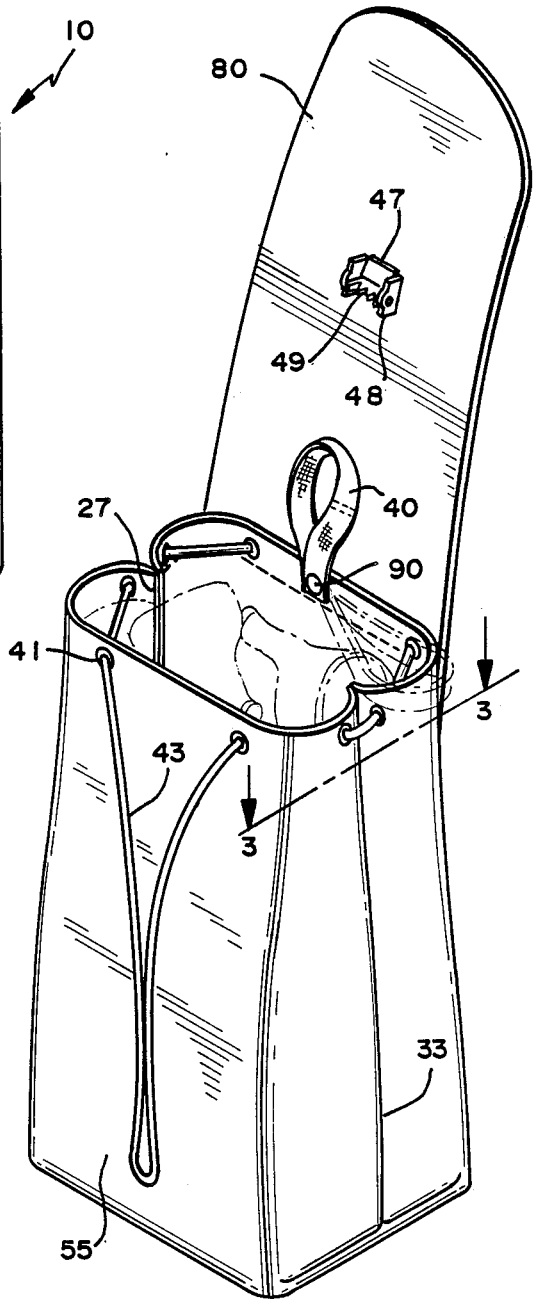
FIG. 2 is a perspective view of the interior of the case in a partially collapsed condition.
Figure 3:
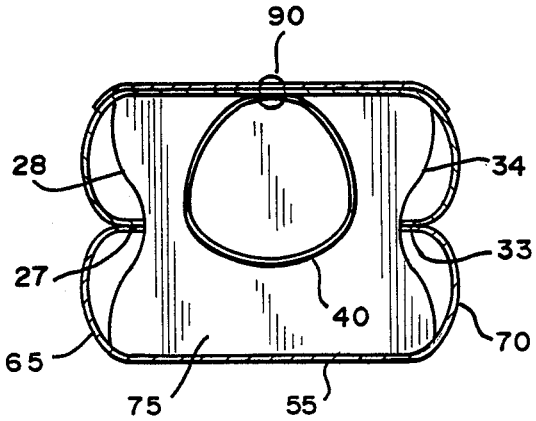
FIG. 3 is a view taken along line 3—3 of FIG. 2.
Figure 6:
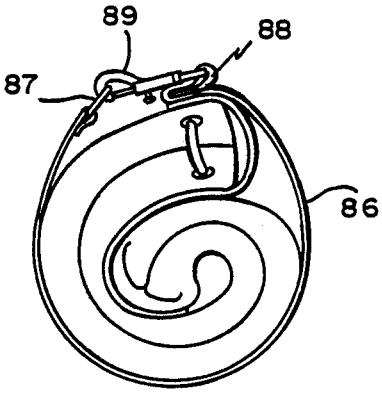
FIG. 6 is a side view of the case which has been folded and rolled-up for storage.
Figure 7:
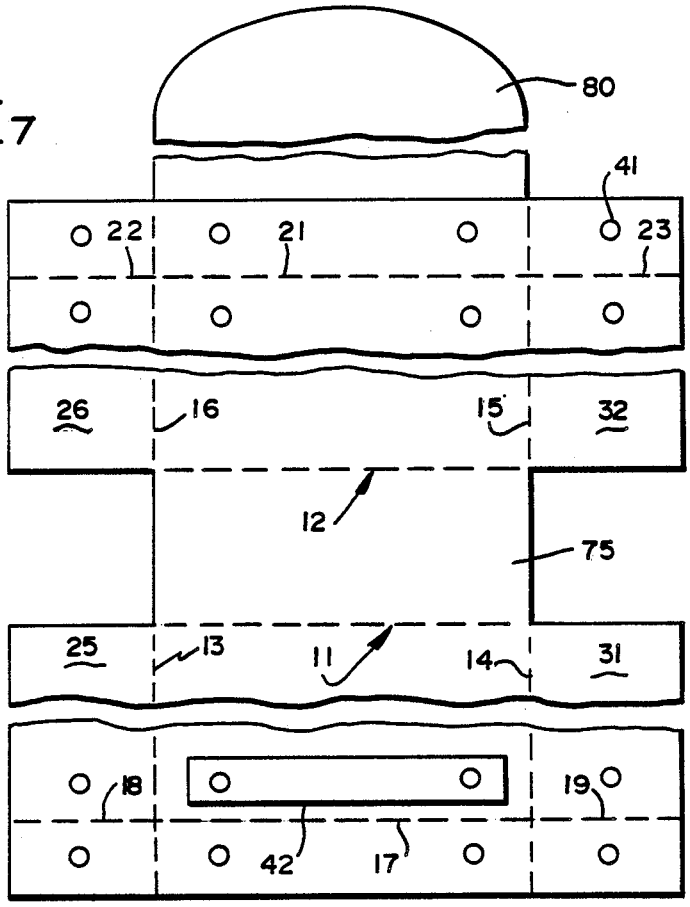
FIG. 7 is a plan view of material which may be used to form a case.
Figure 9:
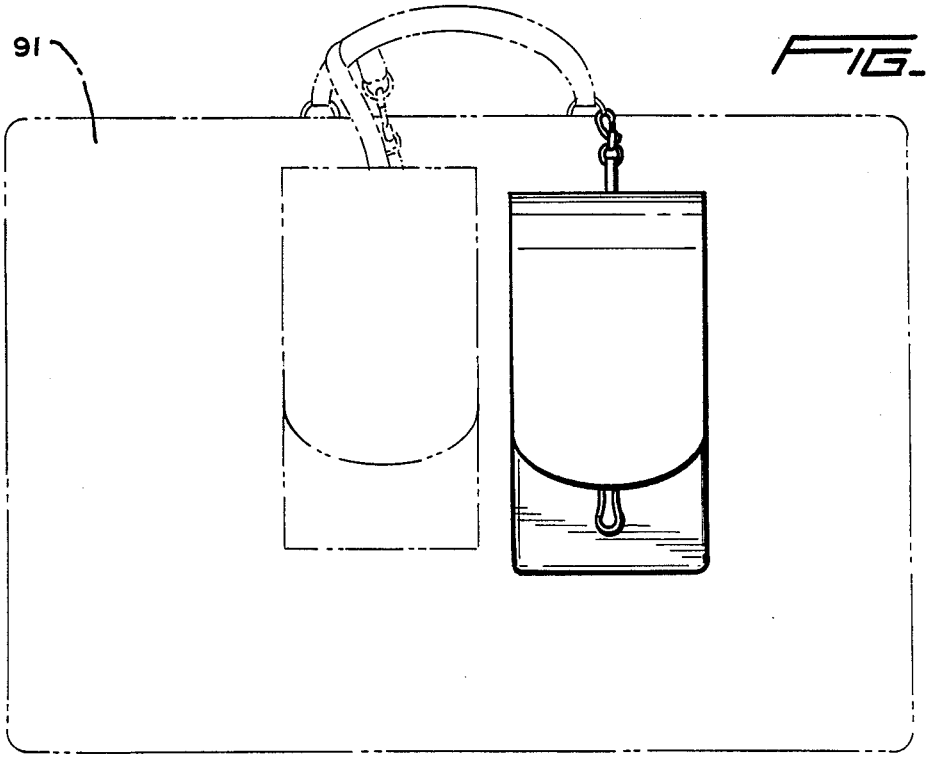
FIG. 9 illustrates the manner in which the case may be attached to other luggage.

In a preferred construction, the case 10, without the flap 80, may be formed of a single piece of material, as generally shown in FIG. 7, with the broken lines 11–16 delineating between the different wall portions of the case. In FIG. 7, panel portions 25, 26 are joined together to form side wall 65 and panel portions 31, 32 are joined together to form side wall 70. The case of FIG. 7 is constructed by sewing the case in an inverted, inside-out position wherein the longitudinal portions of panels 25, 26 are joined together to form a seam 27 as shown in FIGS. 2 and 3, and the edge portions of panels 31, 32 are joined together to form another seam 33 shown in FIGS. 1–3. The lower edge portions of panels 25, 26 are joined to the edge of bottom wall 75 to form a bottom seam 28 shown in FIG. 3, and the lower edge portions of panels 31, 32 are joined to the edge of bottom 75 to form another bottom seam 34 as shown FIG. 3. When the seams are sewn and the case is reinverted to assume the general configuration shown in FIG. 1, the seams will be directed inwardly as shown in the cross-sectional view of FIG. 3. This tends to bias the side walls 65, 70 inwardly toward each other and thereby assist in collapsing the case to assume the flat, rolled-up configuration shown in FIG. 6.

Figure 8:
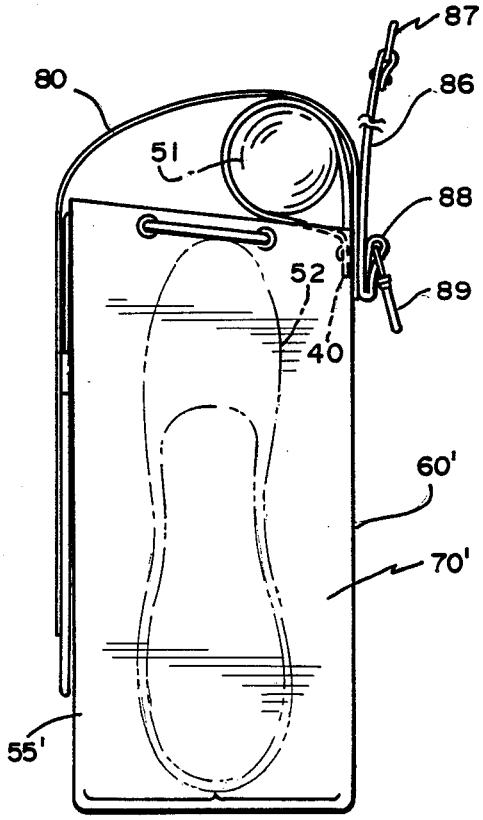
FIG. 8 is a side view of the case depicting various items in broken lines which are carried by the case.

The upper edge portions of the rear wall 60, side walls 65, 70 and the front wall 55 define a mouth of the bag which may be provided with reinforcing means for improving the stability of the body such as when the bag is filled with a plurality of articles, and when applicable, for providing support for items 51 carried in a transverse manner between the mouth 20 of the case and the flap 80, as shown in the modified structure of FIG. 8. The reinforcing means may comprise multiple folds of material which form the upper wall portions of the case where material of suitable stiffness is selected, or, as shown in outline in FIG. 4, separate stiffener elements 35, 36, 37, 38 and 39 may be selectively sewn into one or more pockets formed in the upper wall portions of the case by folding the material about broken lines 17, 18, 19, 21, 22, and 23, as shown in FIG. 7. A front stiffener element 42 is shown in FIG. 7. While the stiffener elements for the front and rear walls of the case may comprise single elongated elements, as shown for example by the rear stiffener element 37 in FIG. 4, the stiffener elements of each side wall comprise two stiffener elements 35, 36 and 38, 39 respectively for side walls 65, 70. This allows the side walls to deflect inwardly as the case is collapsed into the flattened and rolled-up configuration shown in FIG. 6. In the partially collapsed position shown in broken lines in FIG. 4, such as would occur if shoes or other articles were inserted in the case 10 and the drawstring 43 were tightened, the stiffener elements for the sidewalls would assume an inwardly directed V-shaped profile. This would tend to provide uniform support for articles carried transversely across the mouth of the case, such as shown for example, by auxiliary item 51 in FIG. 8.

Figure 4:
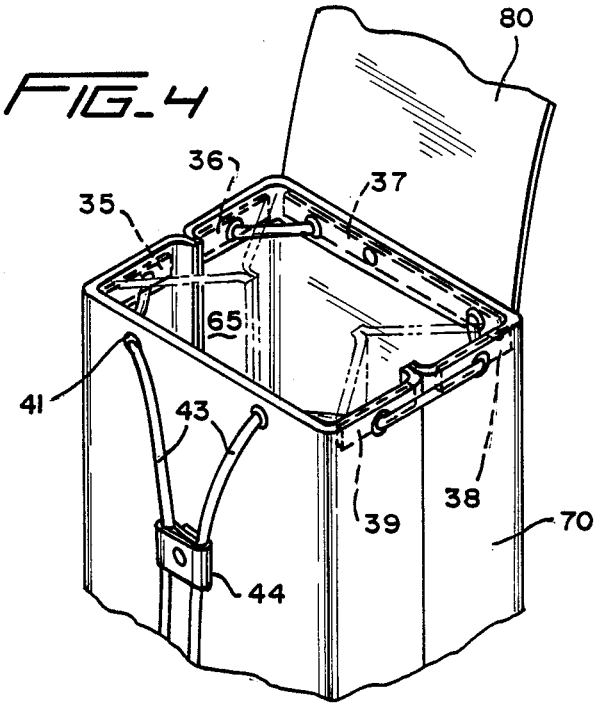
FIG. 4 is a partial perspective view of the interior of the case having reinforced upper wall portions.
Figure 5:
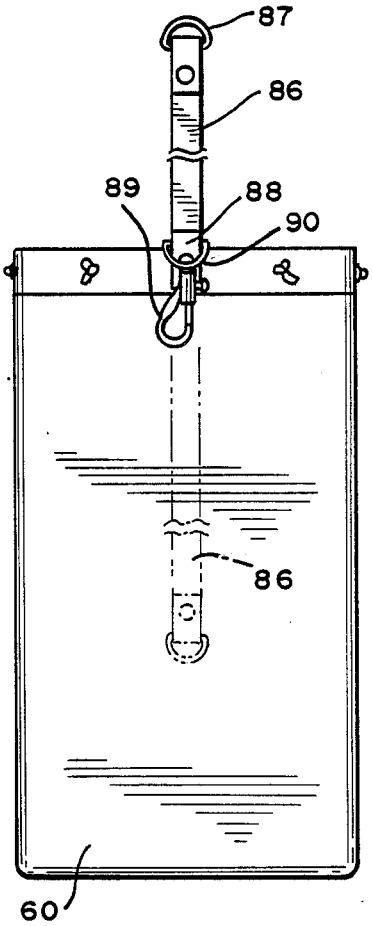
FIG. 5 is a rear view of the case.

The commuter case is also provided with a closure means for drawing the front and rear walls together, thereby drawing the mouth of the bag toward a closed position. The closure means is preferably in the form of a drawstring 43 which extends through apertures 41 in the walls of the case as shown in FIGS. 2 and 4. The end portions of the drawstring 43 are secured to the upper portion of the rear wall 60 as shown in FIG. 5. In use, shoes 52 (shown in broken line in FIGS. 2 and 8) or other articles are inserted in the case 10 and the drawstring 43 is pulled/tightened, thereby partially collapsing the mouth of the case. This not only keeps the contents from moving around within the case but also prevents the contents from falling out of the mouth of the case. One means of holding the drawstring in a tightened manner is a cylindrical sleeve element or tightener 44 shown in FIG. 4 which is pushed upwardly towards the upper portion of the case as the drawstring 43 is tightened. The cylindrical sleeve 44 may be provided with rubberized surfaces to prevent the sleeve from sliding along the drawstring. An additional means of holding the drawstring in a tightened manner comprises a latch means preferably in the form of a clamp 47 comprising pivotal latch 48 which is pivoted from a locked position where a toothed portion 49 of the latch 48 engages the drawstring 43, to an unlocked position wherein the toothed portion is pivoted away from the drawstring. The clamp 47 is preferably dimensioned so that the drawstring 43 and tightener 44 are freely slidable through the clamp 47 when the latch 48 is pivoted to an unlocked, open position.

The flap 80 of the case 10 is sewn or otherwise joined to the outer surface of the case 10, generally adjacent to the upper end portion of rear wall 60. As shown in FIG. 8, the flap 80 has a length dimension which is at least about ½ of the length of the front wall 55', so that the flap can enclose additional items 51 carried by the case 10 as shown in FIG. 8 and so that the flap 80 can partially surround the other portions of the case 10 when it is rolled-up. In use, the flap 80 can either overlie the front wall 55' of the case 10 in an unclamped manner or the flap 80 can be held in an overlying secured position with the front wall 55 of the case by inserting the drawstring 43 through clamp 47 and the latch 48 pivoted to engage the drawstring.

The case shown in the side view of FIG. 8 is the same as the case structure depicted in FIGS. 1 through 4, except that the front wall 55' is longer than the rear wall 60' and the side walls 65' (not shown) 70' have an increasing length dimension when proceeding from the rear wall 60' to the front wall 55'. This configuration provides a mouth which slopes downwardly from the front wall 55' to the rear wall 60' so that the upper surface of the side walls slope downwardly from the front of the case to the rear of the case. This sloping surface and the flap comprise a containment means for biasing items such as an umbrella, newspaper 51, and the like toward the rear wall as shown in FIG. 8. Further support for such articles is provided when the drawstring is tightened as shown in FIG. 4. As noted above, as the drawstring is pulled and the mouth of the case begins to close, the sidewalls fold inwardly and, the reinforced upper end portions of the sidewalls 65, 70 assume a somewhat V-shaped configuration, as shown in FIG. 2 and 4 for example, that tends to stabilize and improve the support capacity of the case 10.

When not in use, the case 10 may be rolled-up into the general configuration shown in FIG. 6. This is accomplished, where applicable, by unlatching the clamp 47 and loosening the drawstring 43, if necessary, and flattening the case. Depending on the particular construction of the sidewalls, they will be folded in half and extend either inwardly or outwardly of the case. Beginning with the bottom of the case, the case is then rolled up toward the mouth of the case. The flap 80 can be rolled up with the wall portions of the case as shown in FIG. 6 or the flap 80 can be wrapped around the outside of the wall portions after they are rolled up. The strap elements for the case, consisting of a long strap element 86 and a shorter strap element 88 are then wrapped around the case and either hooked together as in FIG. 6 or otherwise tied together.

Carrying means for the case 10 comprise a long strap element 86 and a short strap element 88 which are pivotally connected by pivot pin 90 to the upper portion of rear wall 60. The long strap 86 is provided with a ring element 87, and the short strap 88 is provided with a releasable hook means in the form of releasable hook element 89. In use, with the straps 86, 88 pivoted to the upward position shown in FIGS. 5 and 8, the ring 87 and hook 89 can be connected together to form a loop or handle which can be grasped by the user. Alternatively, when it is desired to attach the case to luggage, as shown in broken lines in FIG. 9, the long strap 86 provided with ring 87 is wound around the handle of the luggage 91 and connected to the hook 89 of short strap 88. An alternative use of the strap elements 86, 88 is to pivot the long strap 86 to a downward position, as shown in FIG. 5, and pivot the short strap 88 so that the hook 89 can be attached directly to the hardware which connects a handle to a piece of luggage, as shown in solid lines in FIG. 9. Thus, the short strap 88 and hook 89 are configured to permit the case 10 to be attached directly to other items such as belts, belt loops on pants, zippers, etc... Preferably, the long strap element 86 and short strap element 88 are formed from one piece of flexible material that is divided into two strap elements by placement of the pivot pin along the strap or a fold(s) in the strap. Alternatively, the long strap element 86 and the short strap element 88 are formed from two individual pieces of flexible material wherein the pivot pin is placed along each strap element as shown in FIG. 5.

The inside strap 40, which is removably secured to the inside surface of rear wall 60, can be used for securing items within the case, for securing items which are supported transversely across the mouth of the case, or for holding items such as umbrellas outside of and generally along the outside sidewalls of the case, as shown in broken lines in FIG. 2.

We claim:

1. A flexible bag for carrying personal items, comprising:

a body portion comprising:

front and rear walls;

side walls connected to and extending between the front and rear walls, the upper portions of the front, rear and side walls define an opening which comprises the mouth of the bag; and a bottom connected to the front, rear and side walls;

a flap attached to the upper portion of the rear wall of the bag, for spanning the mouth of the bag and for overlying the front wall of the bag;

flexible closure means connected to the front and rear walls of the bag for drawing the front and rear walls together; and a clamp secured to the flap, the clamp having a fixed portion and a lever portion which pivots from a closed position wherein the lever clamps the flexible closure means between the fixed portion and the lever to an unlocked position wherein the lever pivots away from the fixed portion for permitting withdrawal of the flexible closure means from the clamp.

2. The flexible bag according to claim 1, wherein said flexible closure means comprises a drawstring secured to the rear wall and extending through the side and front walls of the bag, for drawing the walls together to close the mouth of the bag.

3. The flexible bag according to claim 2, wherein the side walls of the bag have inwardly biased seams extending between the upper portion of the side walls adjacent the mouth of the bag and the lower portion of the side walls adjacent the bottom of the bag, so that when the front and rear walls are drawn towards each other to close the mouth of the bag, the side walls of the bag fold inwardly toward each other along the inwardly biased seams.

4. The flexible bag according to claim 3, further comprising:

strap means connected to the exterior surface of the rear wall of the bag for carrying the bag.

5. A flexible bag for carrying personal items, comprising:

a body portion comprising:

front and rear walls;

side walls connected to and extending between the front and rear walls, wherein the upper portions of the front, rear and side walls define an opening which comprises the mouth of the bag; and a bottom connected to the front, rear and side walls; wherein the upper portion of the rear wall is provided with elongated reinforcing means that extend generally along the mouth of the bag for improving the stability of the body and wherein the side walls of the body have inwardly biased seams extending from an upper portion of the body adjacent the mouth thereof to a lower portion of the body so that as the front and rear walls are drawn towards each other, the side walls of the bag collapse inwardly toward each other;

a flap attached to the upper portion of the rear wall of the bag, for spanning the mouth of the bag and for overlying the front wall of the bag; and flexible closure means connected to the front and rear walls of the bag for drawing the front and rear walls together, thereby drawing the mouth of the bag toward a closed position.

6. The flexible bag according to claim 5, wherein the upper portion of the front wall of the body is provided with elongated reinforcing means of folds of bag material to form thickened portions extending generally along the mouth of the bag for improving the stability of the body.

7. The flexible bag according to claim 5, wherein upper portions of the side walls of the body adjacent the mouth thereof are provided with elongated reinforcing means for improving the stability of the body.

8. The flexible bag according to claim 7, wherein the flexible closure means comprises a drawstring secured to the elongated reinforcing means of the rear wall and extending through the side and front walls of the bag for drawing the walls together to close the mouth of the bag.

9. The flexible bag according to claim 7, wherein said closure means comprises a drawstring which is connected to the front, rear and side walls of the bag for drawing the wall portions together to close the mouth of the bag, and further comprising:

internal strap means releasably connected to the interior rear wall of the bag for holding elongated items generally across and spanning the mouth of the bag when the drawstring is drawn to close the mouth of the bag, wherein the elongated reinforcing means of the side walls provide support for carrying the elongated item; and external strap means connected to the upper intermediate portion of the rear wall of the bag for carrying the bag.

10. The flexible bag according to claim 5, wherein the dimension of the side walls measured from the mouth of the body to the bottom of the body is greater adjacent the front wall than adjacent the rear wall so that the mouth of the body slopes downwardly from the front wall to the rear wall.

11. The flexible bag according to claim 5, wherein upper portions of the front, rear and side walls of the body adjacent to and generally along the mouth thereof are provided with elongated reinforcing bars for improving the stability of the body.

12. A flexible bag for carrying personal items, comprising:

a body portion comprising:

front and rear walls;

side walls connected to and extending between the front and rear walls, the upper portions of the front, rear and side walls define an opening which comprises the mouth of the bag and wherein the side walls of the body are inwardly biased so that as the front and rear walls are drawn together, the side walls fold inwardly toward each other; and a bottom connected to the front, rear and side walls;

a flap attached to the upper portion of the rear wall of the bag, for spanning the mouth of the bag and for overlying the front wall of the bag;

flexible closure means connected to the walls of the bag for drawing the front and rear walls together, thereby drawing the mouth of the bag toward a closed position; and strap means pivotally connected to the rear wall of the bag for carrying the bag and for attaching the bag to luggage having a carrying handle apparatus, the strap means including a first strap having a connecting ring means at an end portion and a second strap having a releasable hookshaped connecting means at an end portion, the straps are pivoted together and selectively rotatable between a first position of use wherein the first and second straps extend upwardly from the rear wall and the connecting ring means and the hook-shaped connecting means are connected together so that the first and second straps form a loop for carrying the bag and a second position of use wherein the first strap extends downwardly along the rear wall of the bag and the second strap projects upwardly from the rear wall of the bag for attaching the hook-shaped connecting means to the carrying handle apparatus of the luggage.

13. The flexible bag according to claim 12, wherein the upper portion of the rear wall of the body is provided with elongated reinforcing means that extend generally along the mouth of the bag for improving the stability of the body.

14. The flexible bag according to claim 13, wherein the upper portion of the front wall of the body is provided with elongated reinforcing means that extend generally along the mouth of the bag for improving the stability of the body.

15. The flexible bag according to claim 14, wherein upper portions of the side walls of the body adjacent the mouth thereof are provided with elongated reinforcing means for improving the stability of the body.

16. The flexible bag according to claim 13, wherein the flexible closure means comprises a drawstring secured to the elongated reinforcing means of the rear wall and extending through the side and front walls of the bag for drawing the walls together to close the mouth of the bag.

17. A flexible bag for carrying personal items, comprising:

a body portion, comprising:

a front wall;

a rear wall;

side walls connected to and extending between the front and rear walls, wherein the upper portions of the front, rear and side walls define an opening which comprises the mouth of the bag, wherein the upper portions of the front, rear and side walls of the body adjacent to and generally along the mouth thereof are provided with reinforcing means for improving the stiffness of the mouth of the bag, wherein the side walls of the bag are inwardly biased so that when the front and rear walls are drawn towards each other to close the mouth of the bag, the side walls of the bag tend to fold inwardly toward each other; and a bottom connected to the front, rear and side walls;

a flap connected to the upper portion of the rear wall of the bag, the flap being designed to span the mouth of the bag and overlie the front wall of the bag;

flexible closure means connected to the front and rear walls of the bag for drawing the front and rear walls together, thereby drawing the mouth of the bag toward a closed position;

strap means connected to the rear wall of the bag for carrying the bag, for maintaining the bag in a rolled up configuration for storage purposes and for attaching the bag to luggage having a carrying handle apparatus, the strap means including a first strap having a connecting ring means at an end portion and a second strap, which is shorter than the first strap, having a hook-shaped connecting means at an end portion, the straps are connected together and positionable between a first position of use wherein the first and second straps extend upwardly from the rear wall and the connecting ring means and the hookshaped connecting means are connected together to form a loop for carrying the bag, and a second position of use wherein the first strap extends downwardly along the rear wall of the bag and the second strap projects upwardly from the rear wall of the bag for attaching the hook-shaped means to the carrying handle apparatus of luggage so that the bag is supported from the luggage, and for wrapping the long strap around the bag when the bag is rolled-up for storage and connecting the connecting ring means to the hook-shaped means of the second strap for maintaining the bag in a rolled-up configuration.

18. The flexible bag according to claim 17, wherein said flexible closure means comprises a drawstring secured to the rear wall and extending through the side and front walls of the bag, for drawing the walls together to close the mouth of the bag.

19. The flexible bag according to claim 17 wherein the reinforcing means comprise elongated reinforcing bars.

20. The flexible bag according to claim 17 wherein the reinforcing means comprise an overlapped fold of bag material to form thickened portions extending along the mouth of the bag.

* * * * *